US010502493B2

(12) United States Patent
Freund

(10) Patent No.: US 10,502,493 B2
(45) Date of Patent: Dec. 10, 2019

(54) SINGLE PASS CROSS-FLOW HEAT EXCHANGER

(71) Applicant: General Electric Company, Schenectady, NY (US)

(72) Inventor: Sebastian Walter Freund, Unterfoehring (DE)

(73) Assignee: General Electric Company, Schenectady, NY (US)

( * ) Notice: Subject to any disclaimer, the term of this patent is extended or adjusted under 35 U.S.C. 154(b) by 150 days.

(21) Appl. No.: 15/358,310

(22) Filed: Nov. 22, 2016

(65) Prior Publication Data

US 2018/0142956 A1 May 24, 2018

(51) Int. Cl.
*F28D 7/06* (2006.01)
*F28D 1/04* (2006.01)
(Continued)

(52) U.S. Cl.
CPC ..... *F28D 1/0435* (2013.01); *F28B 1/06* (2013.01); *F28D 1/05308* (2013.01);
(Continued)

(58) Field of Classification Search
CPC ..... F28D 1/0435; F28D 1/05341; F28D 1/05308; F28D 21/0014; F28D 2021/0026;
(Continued)

(56) References Cited

U.S. PATENT DOCUMENTS 1,884,778 A * 10/1932 Lucke ..... F22G 1/005 122/483
6,349,761 B1 * 2/2002 Liu ..... F28F 1/32 165/150
(Continued)

OTHER PUBLICATIONS

Joardar et al., "Heat Transfer Enhancement by Winglet-Type Vortex Generator Arrays in Compact Plain-Fin-and-Tube Heat Exchangers", International Journal of Refrigeration, pp. 87-97, vol. 31, Issue 1, Jan. 2008.
(Continued)

*Primary Examiner* — Claire E Rojohn, III
(74) *Attorney, Agent, or Firm* — Ann Agosti

(57) ABSTRACT

The present application provides a heat exchanger for exchanging heat between two fluid flows in cross-flow arrangement. The heat exchanger includes at least one heat exchanging module including a first heat exchanging component and a second heat exchanging component. The first heat exchanging component including a fluid inlet header, a fluid outlet header, and at least one heat exchanging passageway defining a first tube-side fluid flow path of a first portion of a fluid in a first direction. The second heat exchanging component including a fluid inlet header, a fluid outlet header, and at least one heat exchanging passageway defining a second tube-side fluid flow path in a second direction for an additional portion of the fluid, wherein the first direction is opposed to the second direction. The opposing first tube-side fluid flow path and the second
(Continued)

tube-side fluid flow path equalizing the temperature distribution over the cross-section of a cross-flow fluid exiting the module.

11 Claims, 9 Drawing Sheets

(51) Int. Cl.
*F28D 1/053* (2006.01)
*F28F 1/12* (2006.01)
*F28B 1/06* (2006.01)
*F28D 21/00* (2006.01)
*F28F 1/24* (2006.01)

(52) U.S. Cl.
CPC ..... *F28D 1/05341* (2013.01); *F28D 21/0014* (2013.01); *F28F 1/12* (2013.01); *F28F 1/24* (2013.01); *F28D 2021/0026* (2013.01); *F28D 2021/0064* (2013.01); *F28F 2250/106* (2013.01)

(58) Field of Classification Search
CPC ..... F28D 2021/0064; F28F 1/12; F28F 1/24; F28F 2250/106; F28B 1/06
USPC ..... 165/176
See application file for complete search history.

(56) References Cited

U.S. PATENT DOCUMENTS 6,378,605 B1 * 4/2002 Kutscher ..... F28B 1/06 165/181
6,928,833 B2 * 8/2005 Watanabe ..... B21D 53/085 165/151
6,957,630 B1 * 10/2005 Mastronarde ..... F22B 1/1815 122/406.4
7,963,097 B2 * 6/2011 Mastronarde ..... F28D 7/1623 60/39.511
8,166,776 B2 * 5/2012 Kopko ..... F25B 39/04 62/186
8,235,096 B1 * 8/2012 Mahefkey ..... F28D 15/046 165/104.26
9,188,369 B2 * 11/2015 Kuehl ..... F24F 3/1405
9,322,602 B2 * 4/2016 Lee ..... F28D 1/0478
9,377,253 B2 * 6/2016 Hwang ..... F28F 9/262
10,048,024 B1 * 8/2018 Sole ..... F28D 1/05341
2002/0050337 A1 * 5/2002 Kaspar ..... F25B 39/04 165/41
2003/0051501 A1 * 3/2003 Matsushima ..... F25B 39/02 62/435
2005/0109485 A1 * 5/2005 Kolb ..... B60H 1/00328 165/42
2006/0130517 A1 * 6/2006 Merkys ..... F25B 39/022 62/515
2007/0004074 A1 * 1/2007 Kim ..... B82Y 10/00 438/48
2008/0078537 A1 * 4/2008 Desai ..... F28D 1/0435 165/140
2010/0043442 A1 * 2/2010 Zhang ..... F01K 23/10 60/772
2010/0252237 A1 * 10/2010 Hashimoto ..... F28D 15/046 165/104.21
2010/0276129 A1 * 11/2010 Bodas ..... F01K 9/00 165/157
2010/0282456 A1 * 11/2010 Benignos ..... F28F 1/30 165/182
2011/0017431 A1 * 1/2011 Yang ..... F28D 15/046 165/104.26
2012/0111552 A1 5/2012 Benignos et al.
2013/0020059 A1 * 1/2013 Park ..... B01D 1/065 165/133
2013/0133868 A1 * 5/2013 Lehar ..... F01K 25/08 165/168
2013/0327504 A1 * 12/2013 Bozorgi ..... F28D 15/04 165/104.26
2014/0083653 A1 * 3/2014 Kempers ..... F28F 13/04 165/104.26
2014/0209279 A1 * 7/2014 Aaron ..... F28D 5/02 165/104.13
2015/0047814 A1 * 2/2015 Wilkins ..... F28D 1/0435 165/121
2015/0241131 A1 * 8/2015 Katoh ..... F28D 1/05366 165/140
2015/0360332 A1 * 12/2015 Singh ..... F28D 7/10 29/890.046
2016/0084585 A1 * 3/2016 Stark ..... F28D 15/04 165/104.26
2016/0341481 A1 * 11/2016 Freund ..... F28D 1/0477
2017/0051981 A1 * 2/2017 Singh ..... F28B 1/06
2017/0146299 A1 * 5/2017 Steinbach ..... B21D 53/085
2017/0198973 A1 * 7/2017 Bugler ..... F28C 1/14
2018/0066548 A1 * 3/2018 Freund ..... F01K 23/10
2018/0128525 A1 * 5/2018 Bugler ..... F28D 1/0435
2018/0142956 A1 * 5/2018 Freund ..... F28B 1/06
2018/0216892 A1 * 8/2018 Kaneko ..... B60H 1/00335

OTHER PUBLICATIONS

Bengtson, "A Fin Tube Heat Exchanger Gives Good Air Heat Exchanger EfficiencyA Fin Tube Heat Exchanger Gives Good Air Heat Exchanger Efficiency", Bright Hub Engineering, Feb. 15, 2010.
Moore et al., "Thermal and Flow Characteristics of a Single-Row Circular-Finned Tube Heat Exchanger Under Elevated Free Stream Turbulence", International Journal of Heat and Fluid Flow, pp. 48-57, vol. 57, Feb. 2016.
Khoo et al., "Numerical Investigation of the Thermal-Hydraulic Performance of Finned Oblique-Shaped Tube Heat Exchanger", 15th IEEE Intersociety Conference on Thermal and Thermo mechanical Phenomena in Electronic Systems (ITherm), pp. 625-632, May 31-Jun. 3, 2016.
Freund, Sebastian Walter, "Combined Cycle Power Plant Having an Integrated Recuperator", U.S. Appl. No. 15/257,917, filed Sep. 7, 2016, pp. 1-30.

* cited by examiner

SINGLE PASS CROSS-FLOW HEAT EXCHANGER

BACKGROUND

The present application relates generally to heat exchangers and more particularly relates to a single pass cross-flow heat exchanger with improved temperature distribution.

Heat exchanging systems, employing heat exchangers, are widely used in applications such as space heating, refrigeration, air conditioning, power plants, chemical processing plants and numerous engines, machines, vehicles and electrical devices. Heat exchangers may be employed in these various applications for efficient heat transfer from one medium to another, and more particularly to exchange heat between two fluids. For example, a first fluid at a higher temperature may be passed through a first channel or passageway, while a second fluid at a lower temperature may be passed through a second channel or passageway. The first and second passageways may be in contact or close proximity, allowing heat from the first fluid to be passed to the second fluid. Thus, the temperature of the first fluid may be decreased and the temperature of the second fluid may be increased.

In general, heat exchangers may be classified according to their flow configuration as crossflow heat exchanging systems, parallel heat exchanging systems, counter flow heat exchanging systems, or in terms of their geometry and design as shell and tube heat exchangers, plate heat exchangers, and finned tube heat exchangers, among many others.

One of the main design goals in the construction of heat exchangers focuses on maximizing heat transfer while minimizing the pressure loss therethrough. Generally described, the extent of the pressure loss and heat transfer factors into the operating costs and the overall energy losses and efficiency of the heat exchanger and its use. Accordingly, in heat exchange applications it is advantageous to utilize a design with a low-pressure loss and a relatively high heat transfer. Of particular concern here are single-pass cross-flow heat exchangers employing multiple tube rows or similar passageways that are commercially available and suitable for use in heat exchange applications where the volume flow rate of a tube-side fluid inside the tubes is too high to pass through a single row of tubes in a crossflow configuration with a fin-side fluid.

Two critical issues emerge when designing a heat exchanger with multiple tube rows in parallel in a single-pass cross-flow arrangement e.g. for a superheater or reheater section in a heat recovery steam generator (HRSG), an air-cooled condenser or for a gas turbine (GT) recuperator. One such issue relates to the tube-side fluid outlet temperatures and the heat duty of the individual tubes as they may differ significantly from the first to the last row. Another issue relates to the temperature distribution over the cross section of the fin-side fluid exiting the heat exchanger being low on one side and high on the other side.

Accordingly, there is a desire for an improved single-pass cross-flow heat exchanger that provides an even fluid temperature distribution of a tube-side fluid exiting a tube-side fluid flow path without uneven heating and hot spots as well as an even fluid temperature distribution of a fin-side fluid exiting a fin-side fluid flow path. The improved design provides for a lower maximum tube temperature, more even tube side outlet temperature distribution, thus enabling lower grade materials and increased lifetime from reduced thermal loads and stresses. Such a heat exchanger preferably may be used for a variety of gas to gas, gas to liquid or gas to steam heat transfer applications and specifically may be used for steam superheaters, steam reheaters, gas turbine recuperators or air-cooled condensers in power plants.

BRIEF DESCRIPTION

The present application is directed to an embodiment of a heat exchanger for exchanging heat between two fluid flows in cross-flow arrangement and having improved temperature distribution. The heat exchanger may include at least one heat exchanging module disposed in a cross-flow fluid path configuration, each heat exchanging module comprising a first heat exchanging component and a second heat exchanging component. The first heat exchanging component comprising a fluid inlet header, a fluid outlet header, and at least one heat exchanging passageway disposed therebetween and defining a first tube-side fluid flow path in a first direction for a first portion of a fluid. The second heat exchanging component comprising a fluid inlet header, a fluid outlet header, and at least one heat exchanging passageway disposed therebetween and defining a second tube-side fluid flow path in a second direction, for an additional portion of the fluid, wherein the first direction is opposed to the second direction. The opposing first tube-side fluid flow path and the second tube-side fluid flow path equalize the temperature distribution over the cross-section of a cross-flow fluid exiting the module.

Another embodiment of the present application is directed to a heat exchanger for exchanging heat between two fluid flows in cross-flow arrangement and having improved heat transfer distribution and including a plurality of heat exchanging modules disposed in cross-flow fluid path configuration. Each of the plurality of heat exchanging modules comprises a first heat exchanging component and at least one additional heat exchanging component. The first heat exchanging component comprising a fluid inlet header, a fluid outlet header, and a plurality of heat exchanging passageways disposed therebetween in a parallel arrangement and defining a first tube-side fluid flow path in a first direction for the passage therethrough of a first portion of a fluid. Each of the at least one additional heat exchanging component comprising a fluid inlet header, a fluid outlet header, and a plurality of heat exchanging passageways disposed therebetween in a parallel arrangement and defining a second tube-side fluid flow path in a second direction for the passage therethrough of an additional portion of the fluid, wherein the first direction is opposed to the second direction. The opposing first tube-side fluid flow path and the second tube-side fluid flow path equalize the temperature distribution over the cross-section of a cross-flow fluid exiting the module.

The present application further provides yet another embodiment of a heat exchanger for exchanging heat between two fluid flows in cross-flow arrangement and having improved heat transfer distribution. The heat exchanger may include a plurality of heat exchanging modules disposed in an alternating cross-flow fluid path configuration. Each of the plurality of heat exchanging modules comprises a first heat exchanging component and at least one additional heat exchanging component. The first heat exchanging component comprising a fluid inlet header, a fluid outlet header, and a plurality of heat exchanging passageways disposed therebetween in a parallel arrangement and defining a first tube-side fluid flow path in a first direction for a first portion of a fluid. Each of the at least one additional heat exchanging component comprising a fluid inlet header, a fluid outlet header, and a plurality of heat exchanging passageways disposed therebetween in a parallel arrangement and defining a second tube-side fluid flow path in a second direction for an additional portion of the fluid, wherein the first direction is opposed to the second direction. The first portion of the fluid as a first tube-side fluid flow is guided from the fluid inlet header, through the plurality of heat exchanging passageways, and passes out of the fluid outlet header of the first heat exchanging component. The additional portion of the fluid as a second tube-side fluid flow is guided from the fluid inlet header, through the plurality of heat exchanging passageways, and passes out of the fluid outlet header of the second heat exchanging component. The opposing first tube-side fluid flow path and the second tube-side fluid flow path equalize the temperature distribution over the cross-section of a cross-flow fluid exiting the module.

These and other features and improvements of the present application will become apparent to one of ordinary skill in the art upon review of the following detailed description when taken in conjunction with the several drawings and the appended claims.

BRIEF DESCRIPTION OF THE DRAWINGS

The above and other aspects, features, and advantages of the present disclosure will become more apparent in light of the subsequent detailed description when taken in conjunction with the accompanying drawings in which.

DETAILED DESCRIPTION

As discussed in detail below, embodiments of the present invention include an improved heat exchanging system that discloses heat exchanging tubes arranged to have an alternating flow direction of the tube-side flow paths.

Generally, relevant heat exchanging systems are widely used in applications that either emit a significant volume of waste exhaust fluids at high temperatures or cool a large volume flow of gas or vapor using air. Non-limiting examples of such applications include chemical processing plants, power plants and specifically gas turbine engines and air coolers. The heat exchanging systems are incorporated in some of these applications to recover heat from the waste exhaust fluids. These heat exchanging systems recover heat from the waste exhaust fluids via a process of heat transfer. The heat transfer is a physical phenomenon that facilitates heat exchange between fluids at different temperatures through a conducting wall. The heat exchanging systems work on the phenomena of heat transfer to recover heat from the waste exhaust fluids. The heat exchanging systems have different modes of operation based on the design of the heat exchanging systems. The heat exchanging systems are typically classified according to the operation of the heat exchanging system. Fluids flow within enclosed surfaces in the heat exchanging systems, with the enclosed surfaces providing direction and flow path to the fluids.

Figure 1:
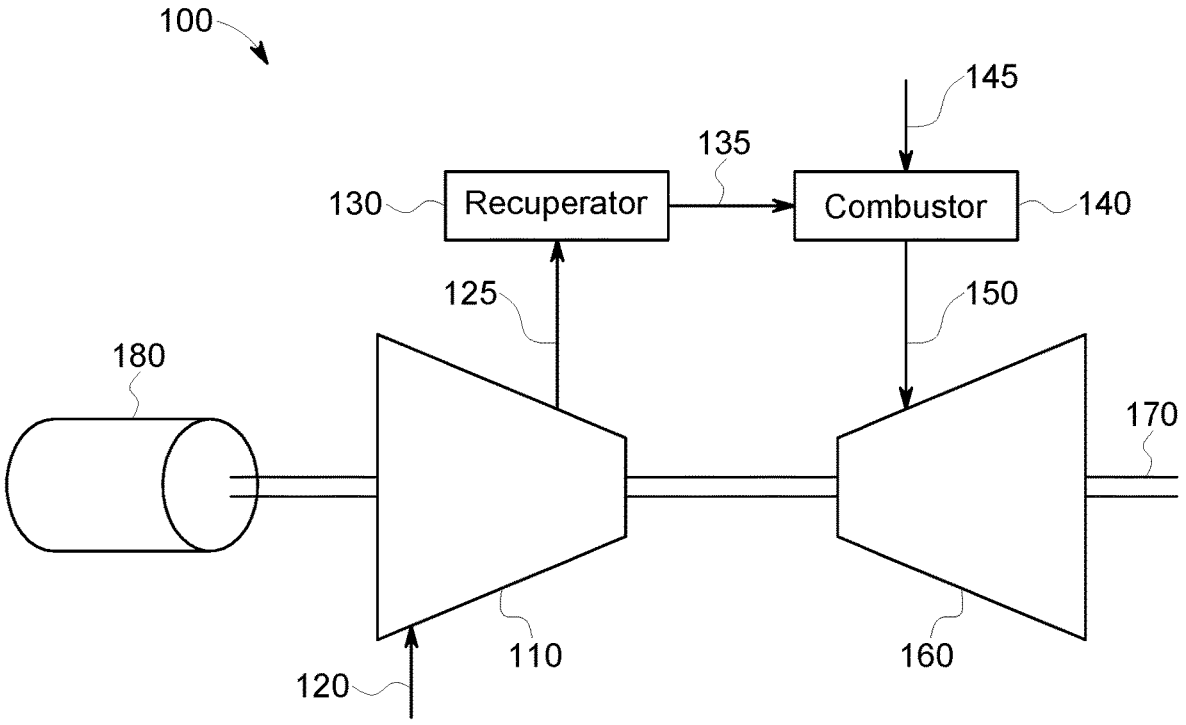
FIG. 1 is a schematic view of a gas turbine engine including a heat exchanger, in accordance with one or more embodiments shown or described herein.

Referring now to the drawings, it is noted that like numerals refer to like elements throughout the several views and that the elements shown in the Figures are not drawn to scale and no dimensions should be inferred from relative sizes and distances illustrated in the Figures. Illustrated in FIG. 1 is a schematic view of a gas turbine engine 100 as may be described herein. The gas turbine engine 100 may include a compressor 110. The compressor 110 compresses an incoming flow of air 120. The compressor 110 delivers a compressed flow of air 125 to a gas turbine recuperator 130. The gas turbine recuperator 130 delivers a cooled, compressed flow of air 135 to a combustor 140. The combustor 140 mixes the compressed flow of air 120 with a compressed flow of fuel 145 and ignites the mixture to create a flow of combustion gases 150. Although only a single combustor 140 is shown, the gas turbine engine 100 may include any number of combustors 140.

The flow of combustion gases 150 is in turn delivered to a turbine 160. The flow of combustion gases 150 drives the turbine 160 so as to produce mechanical work via the turning of a turbine shaft 170. The mechanical work produced in the turbine 160 drives the compressor 110 and an external load such as an electrical generator 180 and the like via the turbine rotor 170.

The gas turbine engine 100 may use natural gas, various types of petroleum-based liquid fuels, synthesis gas, and other types of fuels. The gas turbine engine 100 may be any number of different turbines offered by General Electric Company of Schenectady, N.Y. or otherwise. The gas turbine engine 100 may have other configurations and may use other types of components. Other types of gas turbine engines also may be used herein. Multiple gas turbine engines 100, other types of turbines, and other types of power generation equipment may be used herein together.

Generally described, the gas turbine recuperator 130 may be a heat exchanger, such as disclosed herein, being disposed in a large duct with fluid flow passageways interposed therein such that the compressed flow of air 125 is cooled as it passes through the duct. Other recuperator configurations and other types of heat exchange devices may be used herein.

Figure 2:
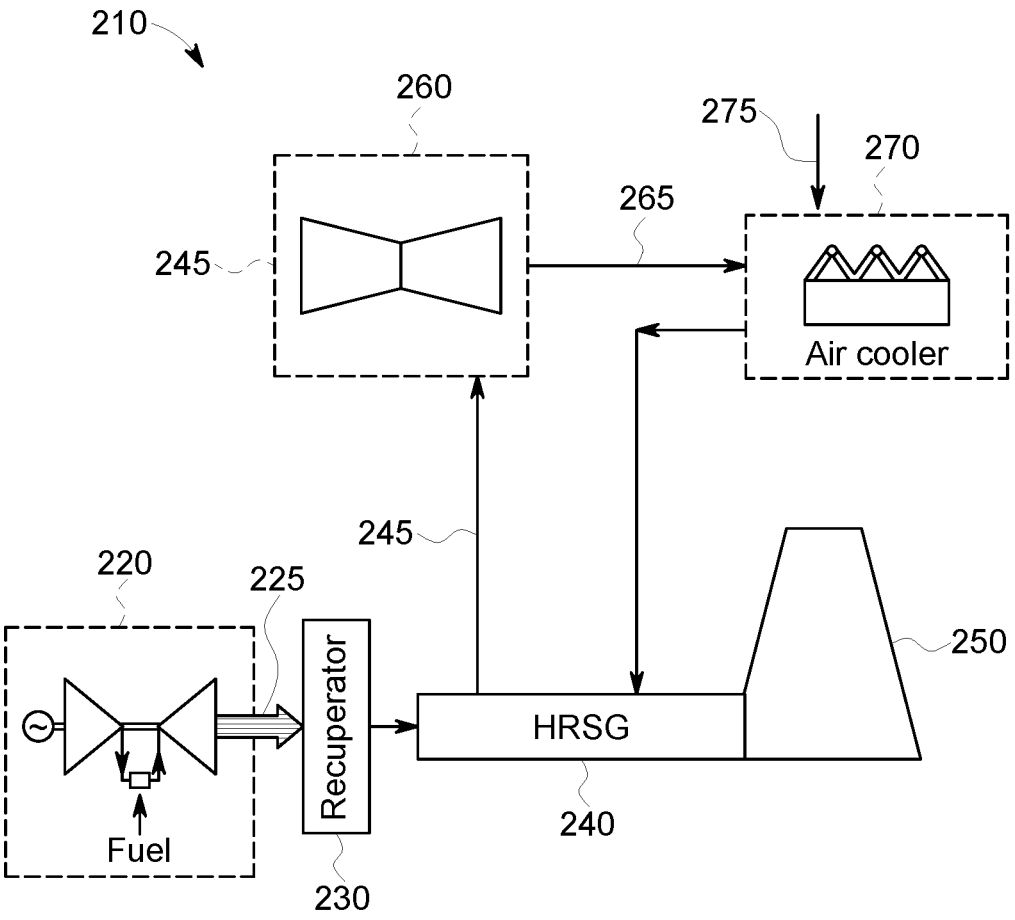
FIG. 2 is a schematic view of a system for use in a power plant including a heat exchanger, in accordance with one or more embodiments shown or described herein.

FIG. 2 shows a schematic view of a system 210 for use in a power plant, such as a combined cycle power plant as may be described herein. For certain combined cycle power plants or in chemical processing plants, to be used in water scarce regions of the world, an air-cooled condenser or air coolers for process or working fluids may be installed due to the unavailability of water. The power plant includes an energy source, such as a gas turbine 220, which generates heat 225 during operations thereof, a recuperator 230, which is coupled to the gas turbine 220, a heat recovery steam generator (HRSG) 240, which is coupled to the recuperator 230, a cooling tower 250 and one or more steam turbines 260. The HRSG 240 generates steam 245 by way of the heat generated by the gas turbine 220 and includes heat exchangers, such as super heaters, evaporators, and pre-heaters, which are disposed along an axis thereof, and by which portions of the generated steam 245 are diverted to the one or more steam turbines 260 to generate power, such as electricity, by way of the diverted steam, and output a spent steam supply 265. An air cooler 270 is configured to fluidly receive and to air-cool at least a steam supply 265. The air-cooled condenser 260 operates with electrically driven fans and cools the steam supply 265 via a supply of air 275.

Generally described, the recuperator 230 may be a heat exchanger, such as disclosed herein, being disposed in a large duct with fluid flow passageways interposed therein such that the heat flow 225 is cooled as it passes through the duct. Other recuperator configurations and other types of heat exchange devices may be used herein. It is noted that the power plant shown in FIG. 2 is merely exemplary and that other configurations of the same are possible.

Figure 3:
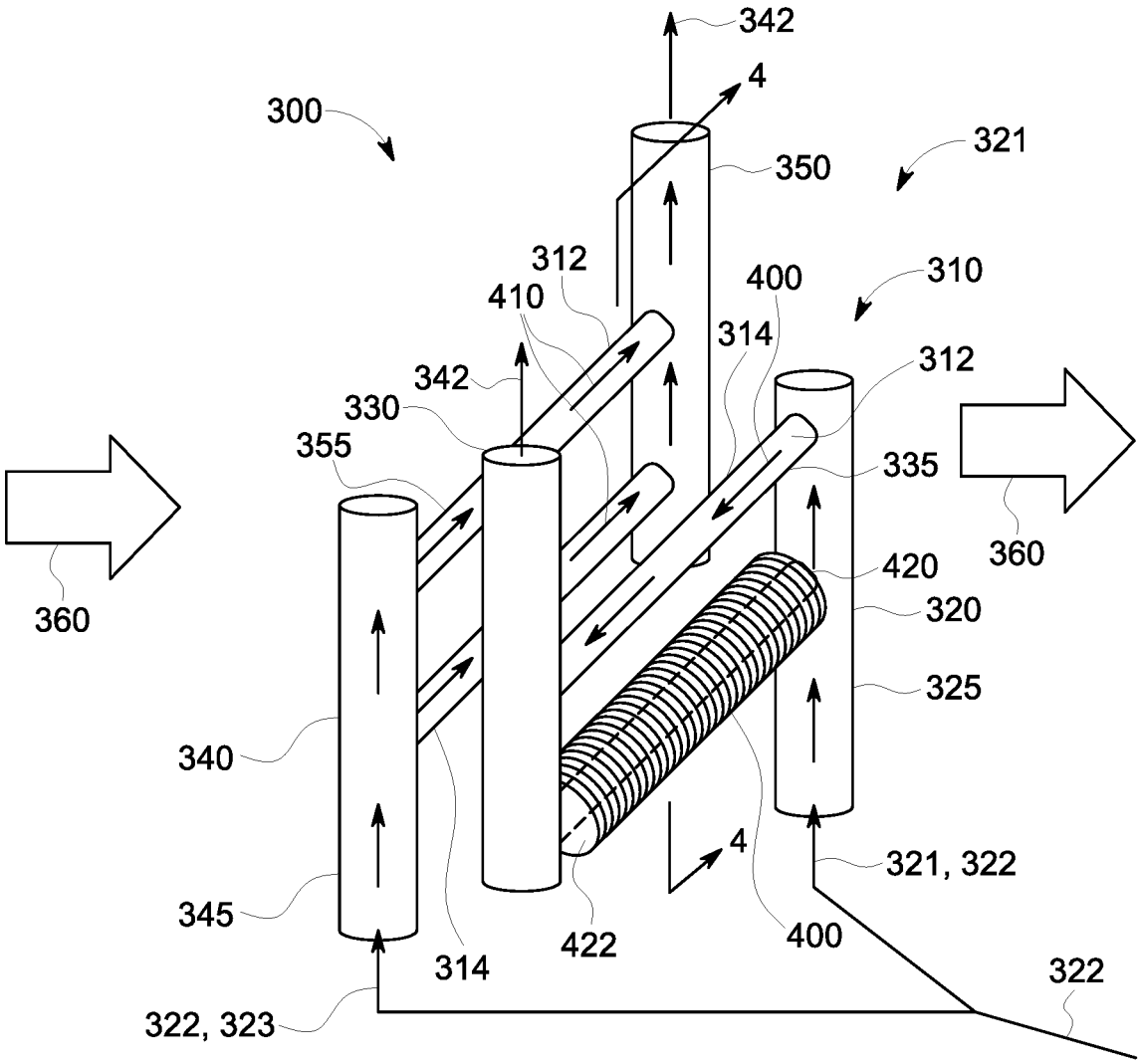
FIG. 3 is a three-dimensional view of a portion of a heat exchanger, in accordance with one or more embodiments shown or described herein.
Figure 4:
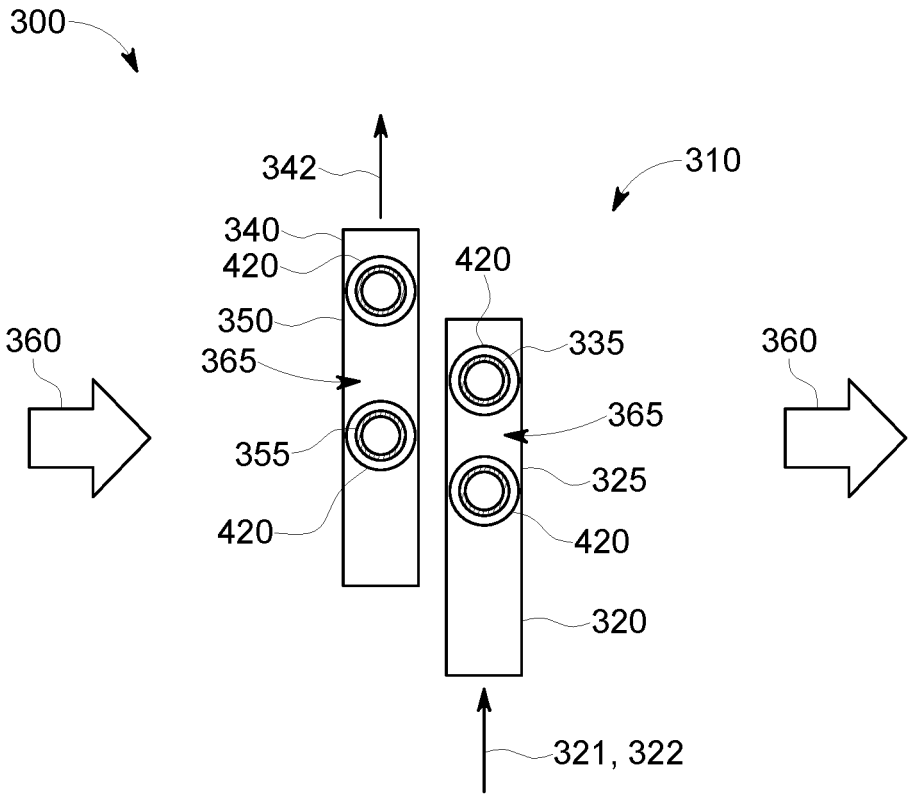
FIG. 4 is a partial cross-sectional view taken though line 4-4 of FIG. 3 of a portion of a heat exchanger, in accordance with one or more embodiments shown or described herein.

Referring now to FIGS. 3 and 4, illustrated is a portion of a heat exchanger 300 according to an embodiment as may be described herein. The heat exchanger 300 may be used as part of the recuperator 130 of FIG. 1, the recuperator 230 of FIG. 2, the air cooler 270 of FIG. 2, or for any type of heat exchange device or purpose.

The heat exchanger 300 is generally comprised of at least one heat exchanging module 310, of which one is illustrated in the figures. Each of the at least one heat exchanging modules 310 includes a first heat exchanging component 320 and a second heat exchanging component 340. Each of the first heat exchanging component 320 and the second heat exchanging component 340 includes a single row 312 of one or more heat exchanging passageways 314. In this particular embodiment, each row 312 is comprised of a plurality of heat exchanging passageways 314, and more particularly a plurality of heat exchanging tubes (described presently), disposed in fluid communication therebetween. In an alternate embodiment, the heat exchanging passageways 314 may include channels of other geometries, such as rectangular channels, in a plate-fin heat exchanger. Referring still to the Figures, as illustrated in FIGS. 3-4, the first heat exchanging component 320 includes a fluid inlet header 325, a fluid outlet header 330 and a plurality of heat exchanging tubes 335 disposed therebetween in a row 312 and providing for the flow through of at least a first portion 321 of a fluid 322, such as a high-pressure fluid (e.g., air, steam). Similarly, the second heat exchanging component 340 includes a fluid inlet header 345, a fluid outlet header 350 and a plurality of heat exchanging tubes 355 disposed therebetween in a row 312 and providing for the flow through of an additional portion 323 of the fluid 322.

Each of the first heat exchanging component 320 and the second heat exchanging component 340 may include any number of heat exchanging tubes 335, 355 disposed therebetween a respective fluid inlet header 325, 345 and fluid outlet header 330, 350. In an embodiment, at least some of the heat exchanging tubes 335, 355 may include a number of fins 420 disposed thereabout. For the sake of clarity, the fins 420 are only illustrated as being disposed on a single heat exchanging tubes 335 of the first heat exchanging component 320. Accordingly, each row 312 may include any number of heat exchanging tubes 335, 355 and fins 420 may be used herein. In an embodiment, the plurality of fins 420 are disposed on each of the plurality of heat exchanging tubes 335, 355. The plurality of fins 420 are spaced from each other in parallel and allow a cross-flow fluid 360 to pass through a plurality of gaps 422 formed therebetween. The heat exchanger 300 may be relatively compact as compared to existing tube heat exchangers, but may have any desired size, shape, and/or configuration.

The heat exchanger 300 includes the heat exchanging tubes 335, 355 oriented in a cross-flow configuration, and more particularly substantially perpendicular, to the cross-flow fluid 360, such as a gas, or the like. In an embodiment, the cross-flow fluid 360 is a low-pressure gas, such as an exhaust gas in a large duct, (i.e. an exhaust heat recovery duct). In the embodiment of FIG. 3, the heat exchanging 300 is disposed in a duct (not shown).

The heat exchanging tubes 335, 355 may have substantially similar dimensions, shapes, lengths, diameters, circumferences, sizes, or combinations thereof. In one embodiment, the dimensions, shapes, lengths, diameters, circumferences, sizes, or combinations thereof of the heat exchanging tubes 335 may be identical or equal to the corresponding dimensions, shapes, lengths, diameters, circumferences, sizes, or combinations thereof of the heat exchanging tubes 355. Moreover, in some embodiments, the outer dimensions of the heat exchanging tubes 335, 355 may be similar. Also, in this example, a wall thickness of the heat exchanging tubes 335, 355 may be similar. In alternative embodiments, the wall thickness of the heat exchanging tubes 335, 355 may be different. In addition, in some embodiments, the heat exchanging tubes 335, 355 may be formed using the same material. However, in some other embodiments, different materials may be used to form the heat exchanging tubes 335, 355.

FIG. 3 further illustrated in solid arrowed lines is a tube-side flow 400 of the first portion 321 of the fluid 322 in the first heat exchanging component 320, in dashed arrowed lines is a tube-side flow 410 of the additional portion 323 of the fluid 322 in the second heat exchanging component 340, and the cross-flow fluid 360. As previously indicated, the heat exchanging tubes 335, 355 are installed in a cross flow arrangement with the cross-flow fluid 360, and being distributed and collected fluid inlet headers 325, 345 and fluid outlet headers 330, 350, as best illustrated in FIG. 4, oriented substantially perpendicular to a longitudinal axis of the heat exchanging tubes 335, 355 for the flow through of the cross-flow fluid 360. Having parallel tube-side flows 400 and 410 in a single-pass configuration as described herein increases a cross-sectional area and reduces a loss of pressure compared to a counter-cross flow arrangement with the same number of rows. As illustrated, according to this novel arrangement, the fluid inlet header 325 of the first heat exchanging component 320 and the fluid inlet header 345 of the second heat exchanging component 240 are arranged such that the tube-side flow 400 of the first portion 321 of the fluid 322 is in an opposed direction to the tube-side flow 410 of the additional portion 323 of the fluid 322. This opposite flow configuration equalizes the temperature distribution over the cross section of the cross-flow fluid 360 exiting the module 310 and the tube-side fluid flows 400 and 410 exiting the heat exchanger as a fluid flow 342.

In an embodiment, a complete assembled heat exchanger may comprise a plurality of the multi-row heat exchanger modules 310, as described herein, and thus an alternating flow direction of tube-side flows 400, 410 in each module 310 crossing the cross-flow fluid 360. In an embodiment, a complete assembled heat exchanger may include a plurality of multi-row heat exchanger modules 310 disposed in an alternating configuration in one of a serial arrangement or a parallel arrangement with respect to the tube-side fluid flows 400, 410 and a serial arrangement with respect to the cross-flow fluid 360. By alternating the flow direction of the tube-side flows 400, 410 in one pass, provides for an even temperature distribution of the cross-flow fluid 360 exiting the first heat exchanger module and entering any subsequent heat exchanger stages without uneven heating and hot spots. Furthermore, adapting the fins 420 for each row 312 in terms of fin height and fin density, provides for a lower maximum tube temperature and a more even tube side outlet temperature distribution, enabling lower grade materials and reducing thermal stresses. More particularly, the plurality of fins 420 on each of the plurality of heat exchanging tubes 335, 355 are designed with a fin height and a fin density to provide one of a minimum heat exchanging tube temperature or a maximum heat exchanging tube temperature relative to a total amount of heat exchanged and equalize a temperature distribution of the tube-side flows 400, 410 exiting the plurality of heat exchanging tubes 335, 355 as the fluid flow 342.

Figure 5:
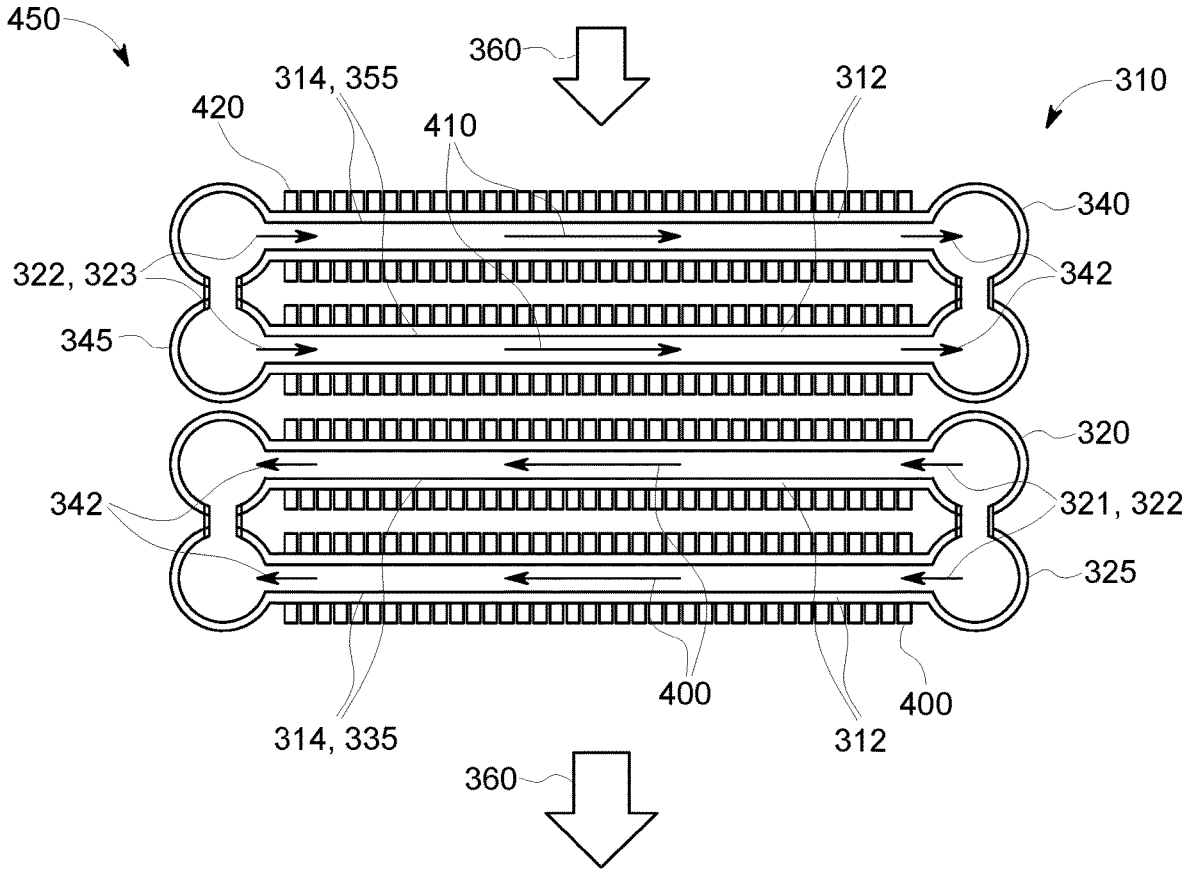
FIG. 5 is a partial cross-sectional top view of another embodiment of a portion of a heat exchanger, in accordance with one or more embodiments shown or described herein.

Referring specifically to FIG. 5, illustrated in partial cross-sectional top view of another embodiment of a heat exchanger, referenced 450, generally similar to the embodiment of FIG. 3, comprising at least one heat exchanging module 310, of which one is illustrated in the figures. As previously described, like numerals refer to like elements throughout the several views. The heat exchanger 450 may be used as part of the recuperator 130 of FIG. 1, the recuperator 230 of FIG. 2, or for any type of heat exchange device or purpose. Each of the at least one heat exchanging modules 310 includes a first heat exchanging component 320 and a second heat exchanging component 340, configured having directionally opposed tube-side flow through paths (described presently). In contrast to the embodiment of FIG. 3, in this particular embodiment, each of the first heat exchanging component 320 and the second heat exchanging component 340 include two rows 312 of heat exchanging passageways 314, and more particularly heat exchanging tubes 335 and 355. Although the illustrated embodiment of FIG. 5 shows only two rows 312 per component 320, 340, it is anticipated that any number of rows may be included for each component.

Similarly illustrated in the embodiment of FIG. 5 is a tube-side flow 400 of a first portion 321 of a fluid 322 in the first heat exchanging component 320, a tube-side flow 410 of the additional portion 323 of the fluid 322 in the second heat exchanging component 340, and the cross-flow fluid 360. A plurality of fins 420 are illustrated as being disposed on the first heat exchanging component 320 and the second heat exchanging component 340. As previously indicated, the heat exchanging tubes 335, 355 are installed in a cross flow arrangement with the cross-flow fluid 360, and defining one or more channels therebetween substantially perpendicular to a longitudinal axis of the heat exchanging tubes 335, 355 for the flow of the cross-flow fluid 360. Similar to the previous embodiment, having parallel tube-side flows 400 and 410 in a single-pass configuration increases a cross-sectional area and reduces a loss of pressure compared to counter-cross flow arrangements. As illustrated, according to this novel arrangement, the fluid inlet headers 325 of the first heat exchanging component 320 and the fluid inlet header 345 of the second heat exchanging component 340 are arranged such that the tube-side flow 400 of the first portion 321 of the fluid 322 is in an opposed direction to the tube-side flow 410 of the additional portion 323 of the fluid 322. This opposite flow configuration equalizes the temperature distribution over the cross section of the cross-flow fluid 360 exiting the module 310 and the tube-side fluid flows 400, 410 exiting the heat exchanger 450 as a fluid flow 342.

The complete assembled heat exchanger 450 comprises a plurality of the multi-row heat exchanger modules 310, as described herein, and thus an alternating flow direction of tube-side flows 400, 410 in each module 310 crossing the cross-flow fluid 360. The complete assembled heat exchanger 450 may include a plurality of multi-row heat exchanger modules 310 disposed in an alternating configuration in one of a serial arrangement or a parallel arrangement with respect to the tube-side fluid flows 400, 410 and a serial arrangement with respect to the cross-flow fluid 360. By alternating the flow direction of the tube-side flows 400, 410 in one pass, provides for an even temperature distribution of the cross-flow fluid 360 exiting the first fluid pass and entering any subsequent heat exchanger stages without uneven heating and hot spots. Furthermore, adapting the fins 420, as previously described, in terms of fin height and fin density, provides for a lower maximum tube temperature and a more even temperature distribution of the tube side outlet flow 342, enabling lower grade materials and reducing thermal stresses.

Figure 6:
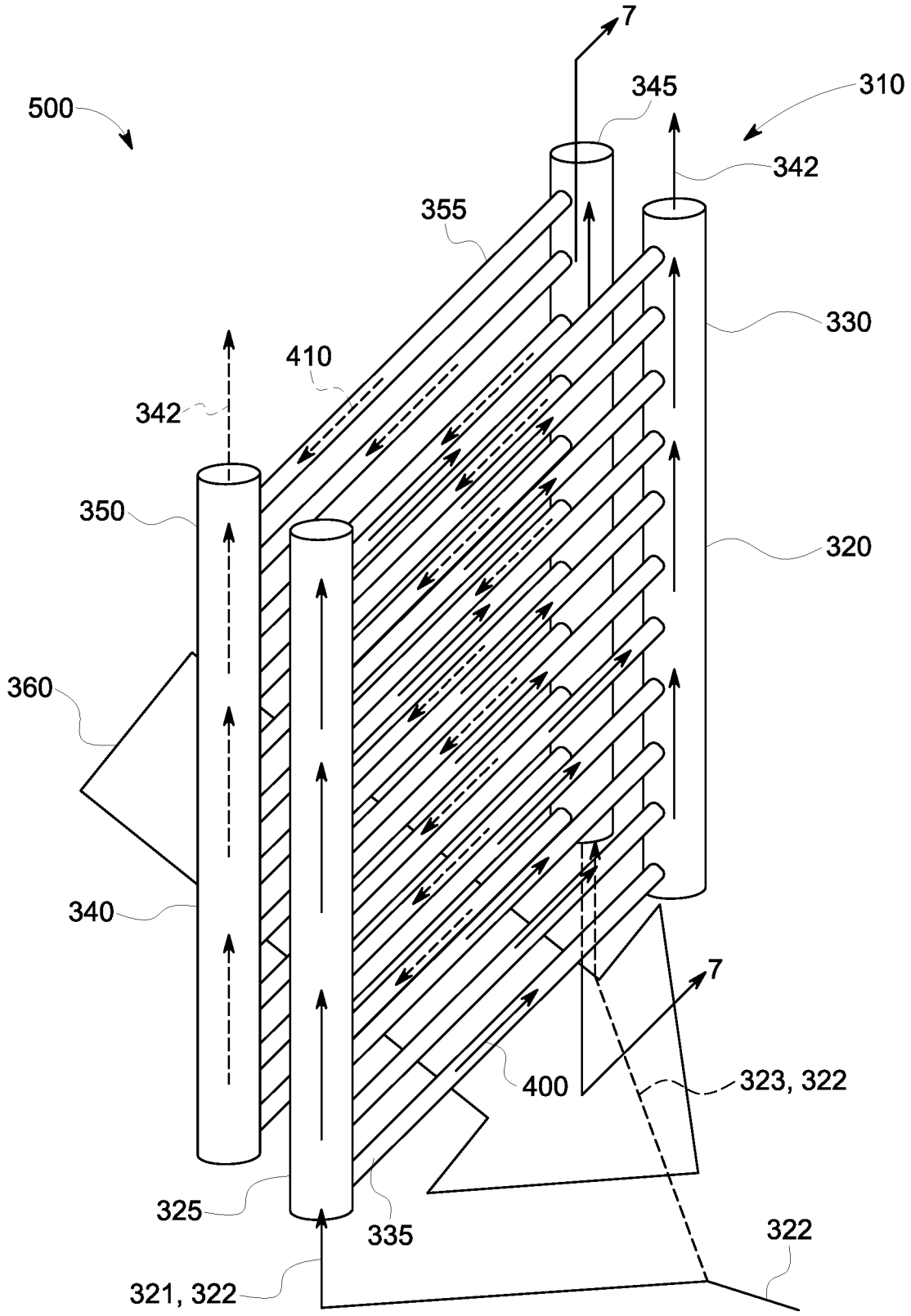
FIG. 6 is a three-dimensional view of a portion of another embodiment of a heat exchanger, in accordance with one or more embodiments shown or described herein.
Figure 7:
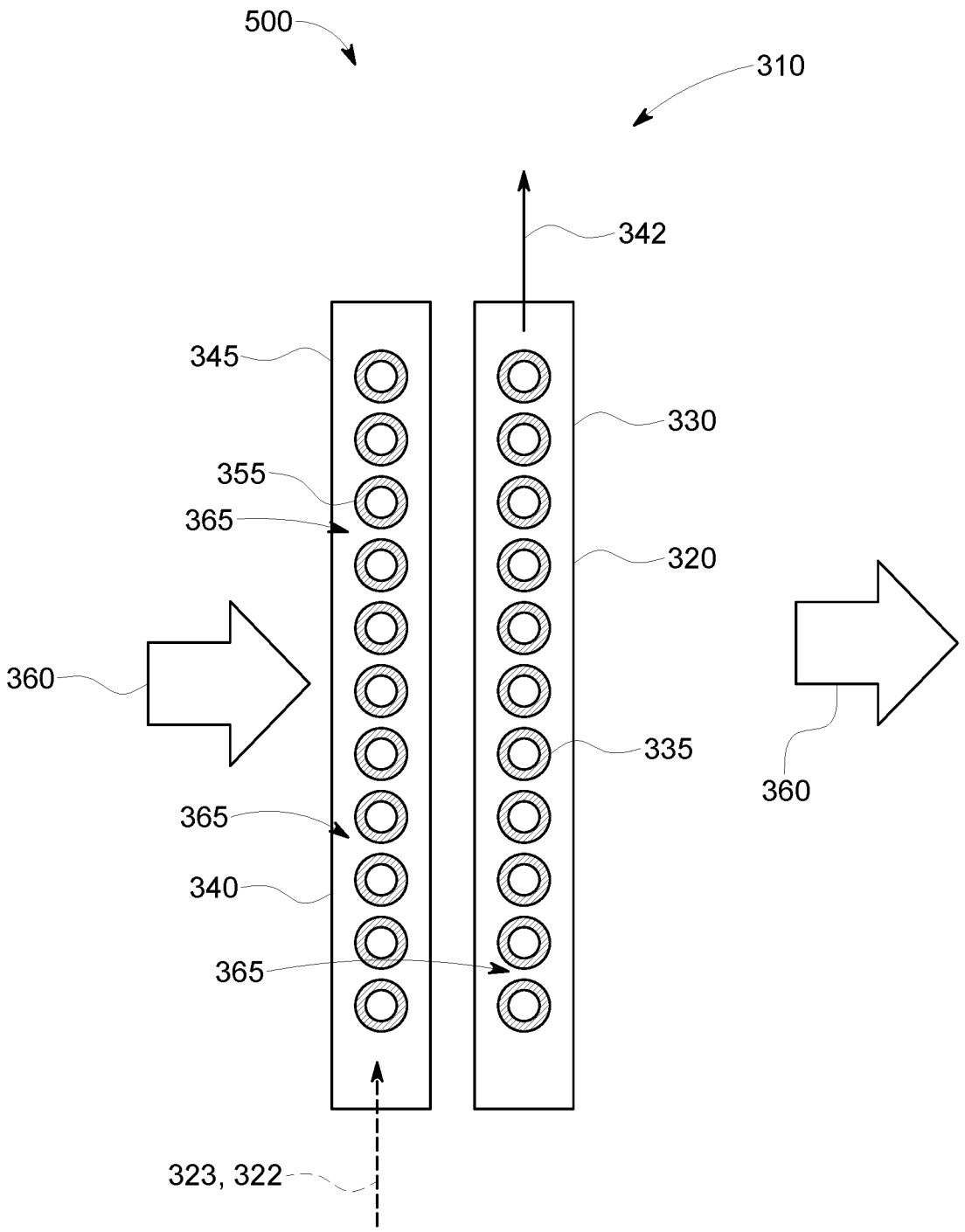
FIG. 7 is a partial cross-sectional view taken though line 7-7 of FIG. 6 of a portion of a heat exchanger, in accordance with one or more embodiments shown or described herein.

Referring now to FIGS. 6 and 7, yet another alternate embodiment of the heat exchanger is illustrated, and generally referenced 500. As previously described, like numerals refer to like elements throughout the several views. The heat exchanger 500 may be used as part of the recuperator 130 of FIG. 1, the recuperator 230 of FIG. 2, the air cooler 270 of FIG. 2, or for any type of heat exchange device or purpose.

The heat exchanger 500 is generally comprised of a plurality of modules 310, of which one is illustrated in the figures. Each of the plurality of modules 310 includes a first heat exchanging component 320 and a second heat exchanging component 340. Each of the first heat exchanging component 320 and the second heat exchanging component 340 is defined by an inlet header, an outlet header and a plurality of passageways 314 disposed in a row 312, that in this particular embodiment comprise a plurality of heat exchanging tubes, disposed in fluid communication therebetween. More particularly, as illustrated in FIGS. 6 and 7, the first heat exchanging component 320 includes a fluid inlet header 325, a fluid outlet header 330 and a plurality of heat exchanging tubes 335 disposed therebetween and providing for the flow through of a first portion 321 of a fluid 322. Similarly, the second heat exchanging component 340 includes a fluid inlet header 345, a fluid outlet header 550 and a plurality of heat exchanging tubes 355 disposed therebetween and providing for the flow through of a additional portion 323 of the fluid 322.

Each of the first heat exchanging component 320 and the second heat exchanging component 340 may include a number of heat exchanging tubes 335, 355 disposed therebetween a respective fluid inlet header 325, 345 and fluid outlet header 330, 350. In the illustrated embodiment, the heat exchanging tubes 335, 355 do not include any fins, such as fins 420 (FIGS. 3-5) previously described. In this particular embodiment, an even gas temperature distribution of the cross-flow fluid 360 exiting the heat exchanger 500 and entering any subsequent heat exchanger stages, without any uneven heating and hot spots, may be achieved without finned tubes by alternating the flow direction and by modification of the flow path formed between the heat exchanging tubes 335, 355 so as to increase the heat transfer coefficient in a direction of the tube-side flow path (described presently). In an alternate embodiment, at least some of the heat exchanging tubes 335, 355 may include a number of fins, such as fins 420 (FIGS. 3-5) positioned thereon. Similar to the previous embodiment, the heat exchanger 500 may be relatively compact as compared to existing tube heat exchangers, but may have any desired size, shape, and/or configuration.

The heat exchanger 500 includes the heat exchanging tubes 335, 355 oriented in a cross-flow configuration, and more particularly substantially perpendicular, to a cross-flow fluid 360, such as a gas, or the like. As illustrated, the first heat exchanging component 320 includes eleven heat exchanging tubes 335. Similarly, the second heat exchanging component 340 includes eleven heat exchanging tubes 335. It should be noted that each heat exchanging component 320, 340 may include any number of heat exchanging passageways 314, distributed in any number of rows 312. As previously indicated, the heat exchanging tubes 335, 355 are installed in a cross flow arrangement with the cross-flow fluid 360, and defining one or more channels 365 therebetween substantially perpendicular to a longitudinal axis of the heat exchanging tubes 335, 355 for the flow of the cross-flow fluid 360.

The heat exchanging tubes 335, 355 may have substantially similar dimensions, shapes, lengths, diameters, circumferences, sizes, or combinations thereof. In one embodiment, the dimensions, shapes, lengths, diameters, circumferences, sizes, or combinations thereof of the heat exchanging tubes 335 may be identical or equal to the corresponding dimensions, shapes, lengths, diameters, circumferences, sizes, or combinations thereof of the heat exchanging tubes 355. Moreover, in some embodiments, the outer dimensions of the heat exchanging tubes 335, 355 may be similar. Also, in this example, a wall thickness of the heat exchanging tubes 335, 355 may be similar. In alternative embodiments, the wall thickness of the heat exchanging tubes 335, 355 may be different. In addition, in some embodiments, the heat exchanging tubes 335, 355 may be formed using the same material. However, in some other embodiments, different materials may be used to form the heat exchanging tubes 335, 355.

Referring specifically to FIG. 6, illustrated in solid arrowed lines is a tube-side flow 400 of the first portion 321 of the fluid 322 in the first heat exchanging component 320, in dashed arrowed lines a tube-side flow 410 of the additional portion 323 of the fluid 322 in the second heat exchanging component 340, and the cross-flow fluid 360. As previously indicated, the heat exchanging tubes 335, 355 are installed in a cross flow arrangement with the cross-flow fluid 360. As illustrated, according to this novel arrangement, the fluid inlet header 325 of the first component 320 and the fluid inlet header 345 of the second component 340 are arranged such that the tube-side flow 400 of the first portion 321 of the fluid 322 is in an opposed direction to the tube-side flow 610 of the additional portion 323 of the fluid 322. This opposite flow configuration equalizes the temperature distribution over the cross section of the fluid flow 360 exiting the module 310 and provides a more even temperature distribution of the tube side outlet flows 342.

The complete heat exchanger 500 comprises a plurality of the heat exchanger modules 310, disposed in an alternating flow configuration, so as to provide opposed tube-side flows 400, 410 in each module 310 crossing the cross-flow fluid 360. In an embodiment, the complete assembled heat exchanger 500 may include a plurality of multi-row heat exchanger modules 310 disposed in an alternating configuration in one of a serial arrangement or a parallel arrangement with respect to the tube-side fluid flows 500, 510 and a serial arrangement with respect to the cross-flow fluid 360. By alternating the flow direction of the tube-side flows 500, 510 in one pass, provides for an even temperature distribution of the cross-flow fluid 360 exiting the first fluid pass and entering any subsequent heat exchanger stages without uneven heating and hot spots provides a more even temperature distribution of the tube side outlet flows 342.

Figure 8:
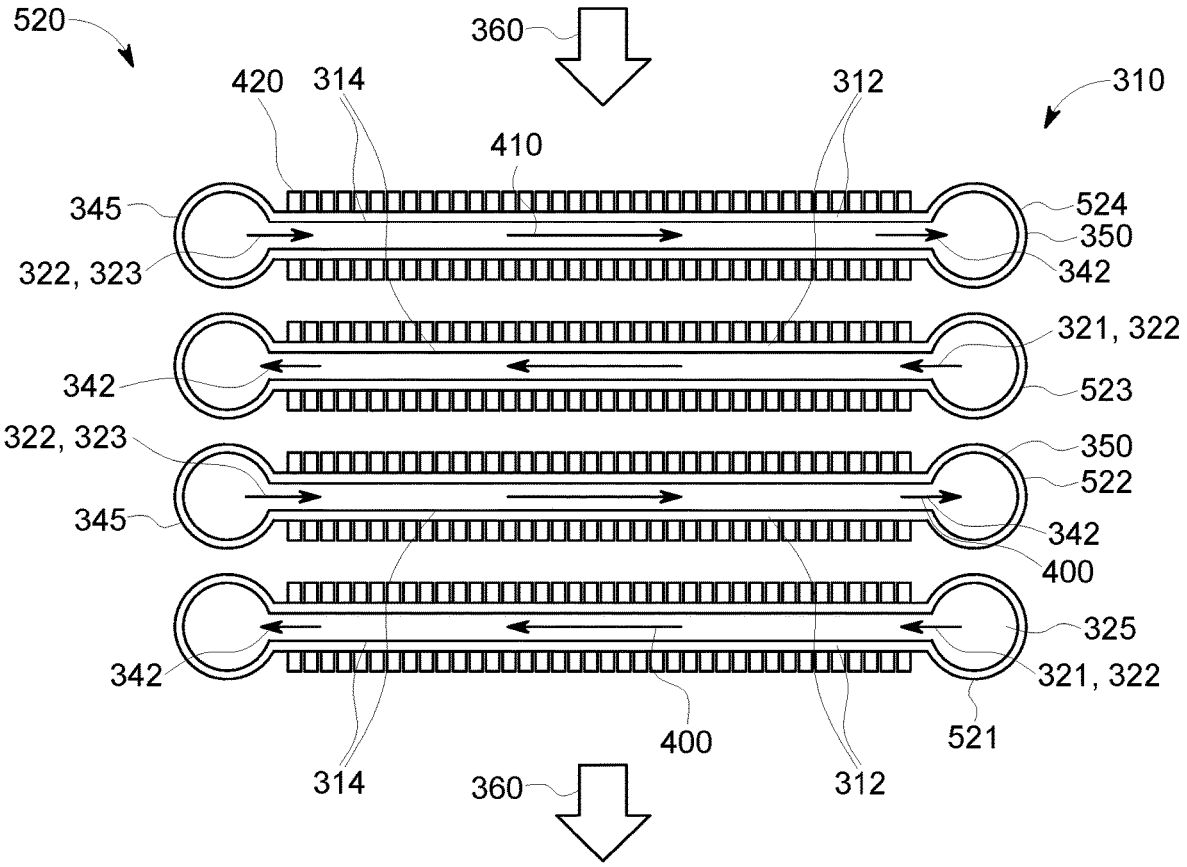
FIG. 8 is a partial cross-sectional top view of another embodiment of a portion of a heat exchanger, in accordance with one or more embodiments shown or described herein.
Figure 9:
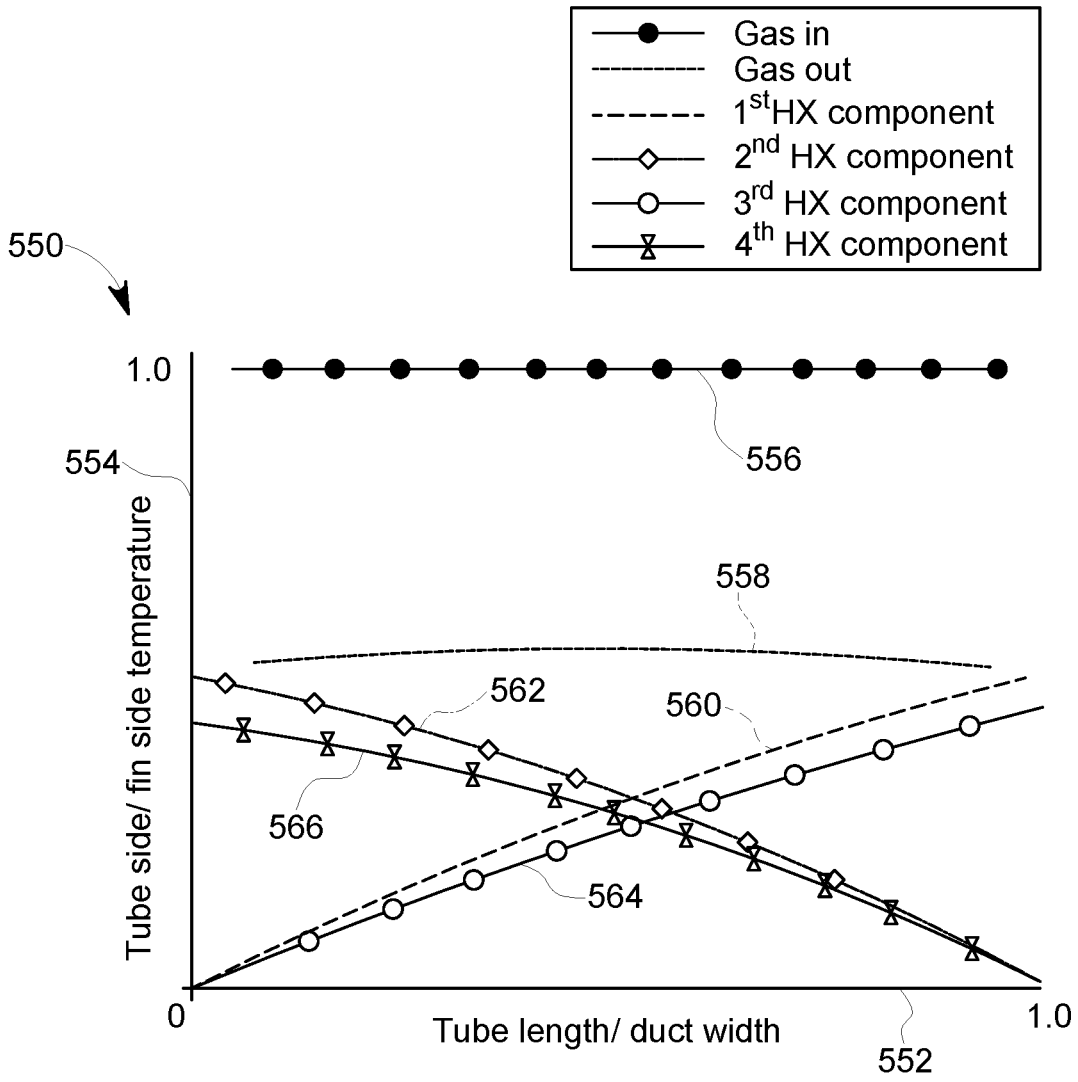
FIG. 9 is graphical illustration of the heat exchanger of FIG. 8 as described herein illustrating computational fluid dynamics and heat transfer coefficient, in accordance with one or more embodiments shown or described herein.

Referring now to FIGS. 8 and 9, an improved heat exchanger, such as a heat exchanger 520 of FIG. 8, is graphically represented in FIG. 9, to illustrate the tube-side and fin-side temperature distribution. As best illustrated in FIG. 8, the heat exchanger 520 is configured generally similar to the previously described embodiments, and accordingly, similar elements will not be described. In this particular embodiment, the heat exchanger 520 is comprised of two (2) heat exchange modules, such as modules 310 of FIG. 3, comprising a total of four (4) individual heat exchanging components 521, 522, 523 and 524, generally similar to components 320 and 340 previously described, and disposed in an alternating flow configuration. It should be noted that FIG. 8 does not illustrate the fluid coupling of the components 521, 522, 523 and 524, one to another, but it should be understood that the fluid inlet headers (not shown) of each component are in fluid communication, as are the fluid outlet headers.

Referring more specifically to FIG. 9, as previously alluded to, in this graphical illustration, the heat exchanger tested was similar to that illustrated in FIG. 8, comprised of two (2) heat exchange modules, such as modules 310 of FIG. 3 comprising a total of four (4) individual heat exchanging components, such as components 521, 522, 523 and 524 of FIG. 8, disposed in an alternating flow configuration. A distance spanning a length of the tube or a duct is represented on the X-axis 552. A temperature of a fluid flow on a fin side or a tube side is represented on the Y-axis 554. The temperature of the cross-flow gas 360 (FIG. 8) is plotted at 556. The fluid flow 360 is input across all the heat exchange components 521, 522, 523 and 524 (FIG. 8), and more particularly along a complete length of the duct) at an even temperature distribution, and exiting at an even distribution plotted at 558. A temperature change along the tube length of a tube-side flow in a row in the first heat exchanging component 521 is plotted at line 560. A temperature change along the tube length of a tube-side flow in a row in the second heat exchanging component 522, disposed in an opposing flow direction to the row in the first heat exchanging component 521, is plotted at line 562. A temperature change along the tube length of a tube-side flow in a row in the third heat exchanging component 523, disposed in an opposing flow direction to the row in the second heat exchanging component 522, is plotted at line 564. A temperature change along the tube length of a tube-side flow in a fourth heat exchanging component 524, disposed in an opposing flow direction to the row in the third heat exchanging component 523, is plotted at line 566. As indicated, the temperature of an output of the cross-flow gas, such as the cross-flow fluid 360, is plotted at line 558 illustrating an equalizing of the temperature distribution across the plurality of heat exchanging components 521, 522, 523, 524 and the duct.

Accordingly, a heat exchanger as disclosed before can have more than 2 rows, such as 4, 6, 8 or more, of which every two consecutive rows in direction of the cross flow fluid have opposed tube-side flow directions. Multiple or even all tube rows with the same flow direction may be arranged with a common distributor and collector header (inlet header/outlet header) on each end. This is a single pass arrangement of tube-side fluid (typically a high-pressure gas or liquid) through the fin-side fluid (typically a low-pressure gas).

As described, the tube-side outlet temperatures from each heat exchanging component can be quite different and in case the tube-side fluid is being heated may exceed a desirable maximum temperature before being mixed in the outlet headers to assume an average temperature. To mitigate this and reduce the outlet temperature of the first heat exchanging component but raise the outlet temperature of downstream heat exchanging components, while maintaining an average outlet temperature essentially constant, a heat transfer coefficient can be modified from lower to higher values from component to component in a direction of the fin-side, or cross-flow fluid 360. Modification of the heat transfer coefficient may be achieved by varying the fin height and density as previously described, as well as by changing the surface on an interior of each heat exchanging tube.

In an embodiment of a gas turbine recuperator with a single-pass configuration of the compressed air in the exhaust upstream of an HRSG, a heat exchanger employing the alternating flow directions of tube-side flows crossing the cross-flow fluid path as disclosed herein will enable placement of the recuperator section immediately upstream of a steam section without interfering with steam flow rates in the evaporator and the tube-to-tube outlet temperatures in steam superheaters and reheaters. Furthermore, in an embodiment employing finned tubes, by adapting the fins for each heat exchanging component as described herein, a lower maximum tube temperature and a more even tube side outlet temperature distribution is achieved. Additional advantages of the heat exchanger described herein include lower costs for lower grade materials and longer lifetime from reduced thermal loads and stresses. More than one such single-pass heat exchanger may be arranged in a counter-cross flow configuration of the tube-side fluid with the fin-side fluid in cross flow, upstream of an HRSG or of without the HRSG upstream of a stack.

It should be understood that the foregoing relates only to the preferred embodiments of the present application and that numerous changes and modifications may be made herein by one of ordinary skill in the art without departing from the general spirit and scope of the invention as defined by the following claims and the equivalents thereof. Such changes and modifications may include, but are not limited to, the use of alternating flow directions of a tube-side flow in any cross flow heat exchanger with a parallel unmixed flow of at least one fluid where an even temperature distribution without hot spots is desired.

The invention claimed is:

1. A heat exchanger for exchanging heat between two fluid flows in cross-flow arrangement and having improved temperature distribution, comprising:

at least one heat exchanging module disposed to receive a fluid and in a cross-flow fluid path configuration with a cross-flow fluid, each heat exchanging module comprising a first heat exchanging component and a second heat exchanging component;

the first heat exchanging component comprising a first fluid inlet header for input of a portion of the fluid, a first fluid outlet header for output of the portion of the fluid, and at least one first heat exchanging passageway disposed therebetween and defining a first tube-side fluid flow path in a first direction, perpendicular to the cross-flow fluid path, for the portion of the fluid; and the second heat exchanging component comprising a second fluid inlet header for input of a remaining portion of the fluid, a second fluid outlet header for output of the remaining portion of the fluid, and at least one second heat exchanging passageway disposed therebetween and defining a second tube-side fluid flow path in a second direction, perpendicular to the cross-flow fluid path and parallel to the first tube-side fluid flow path, for the remaining portion of the fluid, wherein the first direction is opposite the second direction, wherein the opposing first tube-side fluid flow path and the second tube-side fluid flow path equalize a temperature distribution over a cross-section of the cross-flow fluid exiting the at least one heat exchanging module.

2. The heat exchanger of claim 1, wherein the heat exchanger includes a plurality of heat exchanging modules disposed in one of a serial arrangement or a parallel arrangement with respect to the first tube-side fluid flow and the second tube-side fluid flow and a serial arrangement with respect to the second, cross-flow fluid.

3. The heat exchanger of claim 1, wherein at least one of the at least one first heat exchanging passageway or the at least one second heat exchanging passageway in the at least one heat exchanging module comprise a plurality of heat exchanging tubes including a plurality of fins disposed thereon, the plurality of fins spaced from each other in parallel and allowing the second, cross-flow fluid to pass through a gap therebetween.

4. The heat exchanger of claim 3, wherein the plurality of fins on each of the plurality of heat exchanging tubes are designed with a fin height and a fin density to provide one of a minimum heat exchanging tube temperature or a maximum heat exchanging tube temperature relative to a total amount of heat exchanged and equalize a temperature distribution of a tube-side fluid exiting the plurality of heat exchanging tubes.

5. The heat exchanger of claim 1, wherein the portion of the fluid as a first tube-side fluid flow is guided from the first fluid inlet header of the first heat exchanging component, through the at least one first heat exchanging passageway of the first heat exchanging component, and passes out of the first fluid outlet header of the first heat exchanging component, and wherein the remaining portion of the fluid as a second tube-side fluid flow is guided from the second fluid inlet header of the second heat exchanging component, through the at least one second heat exchanging passageway of the second heat exchanging component in the second direction opposing that of the first tube-side fluid flow, and passes out of the second fluid outlet header of the second heat exchanging component.

6. The heat exchanger of claim 5, wherein the first tube-side fluid flow and the second tube-side fluid flow are a high-pressure fluid flow and wherein the second, cross-flow fluid is a low-pressure fluid flow.

7. The heat exchanger of claim 5, wherein the first tube-side fluid flow and the second tube-side fluid flow are one of a vapor or gas and wherein the second, cross-flow fluid is low-pressure air.

8. The heat exchanger of claim 1, wherein the plurality of heat exchanging passageways of the first heat exchanging component and the second heat exchanging component have similar dimensions, shapes, lengths, diameters, circumferences, sizes, or combinations thereof.

9. The heat exchanger of claim 1, wherein the heat exchanger is mounted along an exhaust gas duct.

10. The heat exchanger of claim 9, wherein the heat exchanger is disposed in the exhaust gas duct whereby the plurality of heat exchanging passageways of the first heat exchanging component and the second heat exchanging component are in a perpendicular configuration with respect to a direction of flow of an exhaust gas that composes the second, cross-flow fluid.

11. The heat exchanger of claim 1, wherein the heat exchanger comprises an air-cooled heat exchanger.

* * * * *